United States Patent [19]

Bouman

[11] Patent Number: 5,021,636

[45] Date of Patent: Jun. 4, 1991

[54] ELECTRICAL COOKING UNIT AND ELECTRICAL COOKING APPARATUS PROVIDED WITH THIS UNIT

[75] Inventor: Anton J. Bouman, Eindhoven, Netherlands

[73] Assignee: U.S. Philips Corporation, New York, N.Y.

[21] Appl. No.: 264,490

[22] Filed: Oct. 28, 1988

[30] Foreign Application Priority Data

Nov. 6, 1987 [NL] Netherlands ..... 8702651

[51] Int. Cl.[5] ..... H05B 3/74

[52] U.S. Cl. ..... 219/464; 219/465

[58] Field of Search ..... 219/464, 354, 465, 468, 219/353, 461, 462; 313/579, 634, 578, 522, 52

[56] References Cited

U.S. PATENT DOCUMENTS

| | | | |
|---|---|---|---|
| 263,304 | 8/1882 | Betts | 313/315 |
| 602,953 | 4/1898 | Moore | 313/315 |
| 1,651,287 | 11/1927 | Mayer | 313/522 |
| 1,832,413 | 11/1931 | Nikoloff | 313/522 |
| 2,409,244 | 10/1946 | Bilan | 219/464 |
| 3,309,187 | 3/1967 | Drangeid | 445/22 |
| 3,417,230 | 12/1968 | Milkkan | 219/464 |
| 3,733,462 | 5/1973 | Bouchard | 219/464 |

FOREIGN PATENT DOCUMENTS

| | | | |
|---|---|---|---|
| 53-680 | 1/1978 | Japan | 445/22 |
| 60-227340 | 11/1985 | Japan | 445/22 |
| 69200 | 11/1943 | Norway | 219/465 |
| 1273023 | 5/1972 | United Kingdom | 219/461 |
| 2154405 | 9/1985 | United Kingdom | 219/451 |

*Primary Examiner*—Teresa J. Walberg

*Attorney, Agent, or Firm*—Ernestine C. Bartlett

[57] ABSTRACT

The electrical cooking unit has a housing (1) accommodating an electrical IR lamp (10). The lamp (10) has a lamp vessel (11) which is bent according to an n-gon with several bent portions (14) interconnected by straight portions (15). End portions (12) of the lamp vessel (11) are passed through openings (4) in the side walls (3) of the housing (1) to the exterior.

11 Claims, 1 Drawing Sheet

ELECTRICAL COOKING UNIT AND ELECTRICAL COOKING APPARATUS PROVIDED WITH THIS UNIT

FIELD OF THE INVENTION

The invention relates to an electrical cooking unit comprising:

a housng provided with a base wall and side walls extending from said base wall and having at least one opening;

an electrical IR lamp provided with a tubular lamp vessel sealed in a vacuum-tight manner, having first and second end portions extending beside each other and provided with a respective seal, which lamp vessel extends from its first to its second end portion along a circle, which lamp is arranged in the housing so that its end portions are passed through the at least one opening in its side walls to the exterior. The invention also relates to a electrical cooking apparatus provided with such as electrical cooking unit.

BACKGROUND OF THE INVENTION

Such a cooking apparatus and such a cooking unit are known from GB 1 273 023.

In the known cooking unit, the lamp vessel of the IR lamp is bent circularly but for the end portions extending parallel to each other. The advantage of such a lamp vessel is that a hot plate under which the unit is arranged is heated during operation over a surface area of the size of a cooking position more uniformly than with a linear tubular lamp.

A disadvantage of the known IR lamp is that the lamp is fairly expensive due to a time-consuming manufacturing step, in which the lamp vessel or a tube from which the lamp vessel is to be formed is bent. When bending a finished lamp having a lamp vessel sealed in a vacuum-tight manner, there is a risk that the lamp vessel is unintentionally deformed due to the fact that the gas pressure in the lamp vessel increases as a result of temperature increase. The increased temperature required for bending the lamp vessel must therefore be brought about only in the short zone traversing slowly the whole lamp vessel, while the already bent part is being cooled. Since for IR lamps mostly glass is used having a comparatively high softening temperature, for example glass having an $SiO_2$ content of at least 95% by weight, such as, for example, quartz glass, the step of bending the lamp vessel is time-consuming.

Also if a glass tube from which a lamp vessel is to be formed is circurlarly bent before the lamp is assembled, the bending step is time-consuming, though to a smaller extent than if a finished lamp vessel is bent. The tube can be brought in one step to the required high temperature throughout its length between the end portions. A disadvantage of a bent still open lamp vessel, however, is that a filament provided with supports to keep the filament in a centered position in the lamp vessel at a certain distance from its wall can be introduced only with difficulty into such a lamp vessel. The supports then in fact act as barbed hooks, which impede the introduction of the filament.

SUMMARY OF THE INVENTION

The invention has for its object the provision of an electrical cooking unit and a cooking apparatus provided with such a unit of the described in the opening paragraph, having an electrical IR lamp of a shape that can be readily manufactured.

According to the invention, this object is achieved in an electrical cooking unit of the kind described in that the lamp vessel is bent between the end portions according to an n-gon with substantially equal angles, where $n \geqq 6$, while bent portions are interconnected by straight portions.

The lamp vessel of the unit according to the invention need be heated and bent during its manufacture, only at several areas. The straight portions can remain untreated. As a result, this unit can be manufactured more readily and more rapidly, while nevertheless the advantage of a more uniform heating of an area above the cooking unit is maintained due to the face that the lamp vessel extends between its end portions along a circle.

Due to the fact that the angles are at least substantially equal, they can be made in the same bending arrangement. A lamp vessel bent into the form of a regular octagon is particularly suitable. Also the angles the end portions of the lamp vessel enclose with the adjacent straight portion of the polygonal lamp vessel part are then equally large as the angle adjacent straight portions enclose with each other. All bending steps can then be carried out in the same bending arrangement. A lamp vessel bent according to a decagon is also attractive because of its ease of manufacture and its heating uniformity.

On the condition that a helically wound filament has an operating temperature of at most about 1500° C., for example a temperature in the range of about 1200 to about 1500° C., it is advantageous to arrange the filament in the lamp vessel without using supports. The filament then bears on the wall of the lamp vessel. Due to the absence of supports, the filament in fact is readily slipped into an already bent tube.

Depending upon the nominal operating voltage and the power consumption, the filament may be a wire, consisting, for example, of tungsten, wound as a single or a double helix. The lamp vessel may contain besides an inert gas a halogen or a halogen compound.

In order to adjust the power consumed by a cooking unit, an electrical cooking apparatus can comprise an electronic power regulator.

BRIEF DESCRIPTION OF THE INVENTION

An embodiment of an electrical cooking unit and of an electrical cooking apparatus according to the invention is shown in the drawing. In the drawing.

DETAILED DESCRIPTION OF THE PREFERRED EMBODIMENTS

Figure 1:
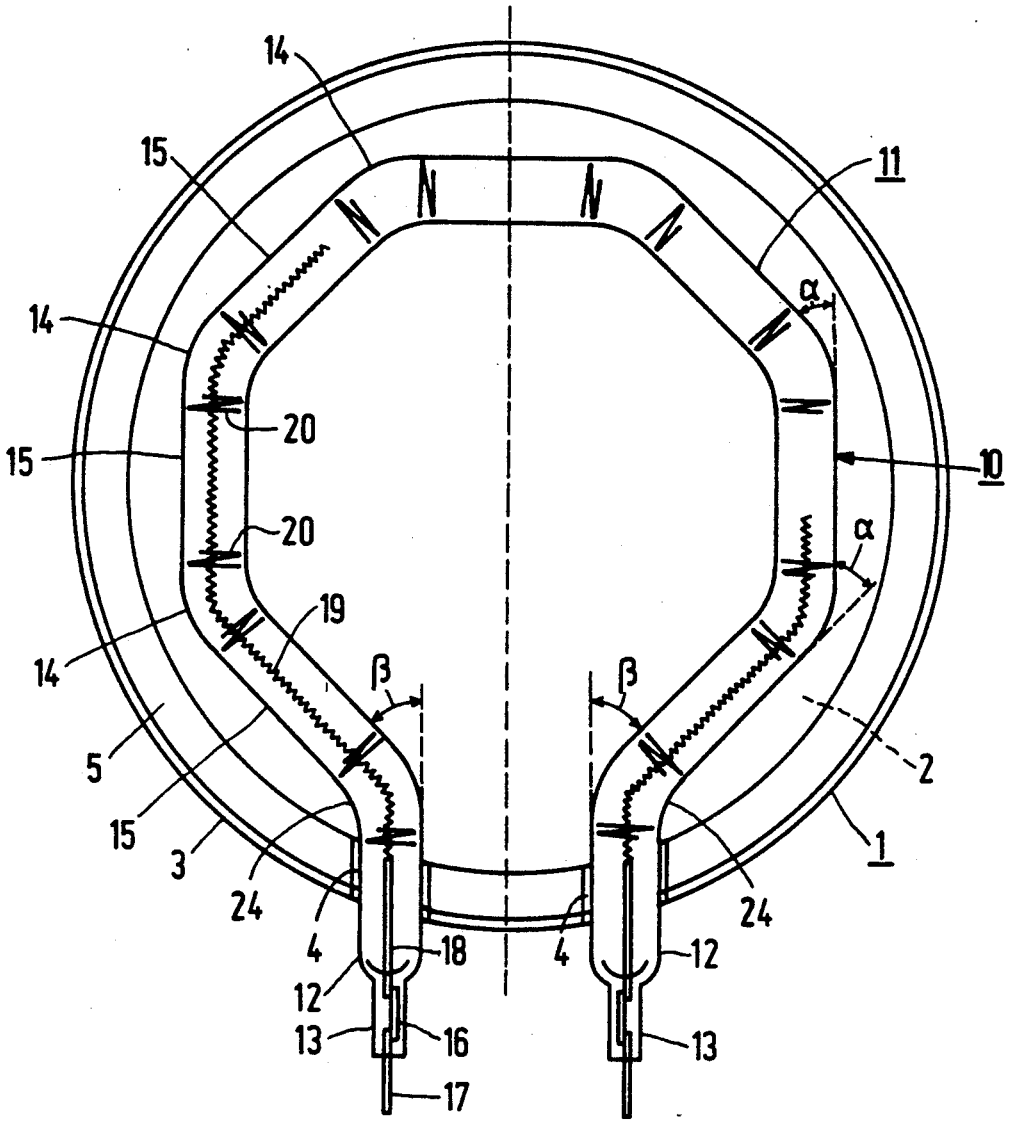
FIG. 1 is a plan view of an electrical cooking unit.

In FIG. 1, the electrical cooking unit has a housing 1, which has a base wall 2 and side walls 3 extending from this wall and having at least one opening 4. In the embodiment shown, the wall are covered with a thermally insulating material 5. An electrical IR lamp 10 has a tubular lamp vessel 11 sealed in a vacuum-tight manner, and having first and second end portions 12 extending beside each other and provided with a respective seal 13, which lamp vessel extends from its first to its second end portion along a circle. The lamp vessel consists, for example, of a glass having an $SiO_2$ content of at least 95% by weight. A respective metal foil 16 is embedded in the seals 13 and a respective outer current conductor 17 and a respective inner current conductor 18 to a tungsten filament 19 arranged in the lamp vessel 11 are connected to this respective metal foil. The filament 19 is kept in a centered position by supports 20. The electrical IR lamp 10 is arranged in the housing 1 so that its end portions 12 are passed through the at least one opening 4 in its side walls 3 to the exterior. The lamp vessel 10 is bent between the end portions 12 according to an n-gon with substantially equal angles ($180-\alpha°$), where $n \geqq 6$ and has been portions 14, which are interconnected by straight portions 15. In the Figure, the lamp vessel 11 is bent in a flat plane into the form of a regular octagon. Not only are the angles $\alpha$ equal to each other, but because of the octagon also the angles $\beta$ of the bent portions 24 are equal to the angle $\alpha$ since the end portions extend parallel to each other. In the Figure, the straight portions 15 are equally long, but if it should be necessary for the end portion 12 to be located close to each other or farther remote from each other, for example, the straight portions 15 adjoining the bent portions 24 may be longer and shorter, respectively. The lamp 10 is filled up to a pressure of 1 bar with argon, to which 0.2% by volume of $CH_2Br_2$ and 0.15% by volume of $CH_3I$ may be added.

Figure 2:
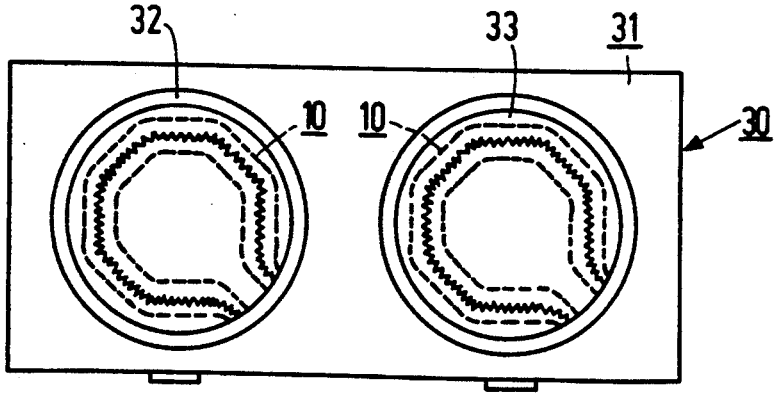
FIG. 2 is a plan view of an electrical cooking apparatus.

In FIG. 2, the electrical cooking apparatus 30 has a hot plate 31 of a material transparent to IR radiation, for example glass ceramic, with two cooking positions 32, 33 under which a respective cooking unit according to the invention comprising an electrical IR lamp 10 is situated.

What is claimed is:

1. An electrical cooking unit comprising:

a housing provided with a base wall and side walls extending from the base wall and having at least one opening, an electrical IR lamp provided with a tubular lamp vessel sealed in a vacuum-tight manner, having first and second end portions extending beside each other and provided with a respective seal, which lamp vessel extends from its first to its second end portion, which lamp is arranged in the housing so that its end portions are passed through the at least one opening in its side walls to the exterior, wherein the lamp vessel is bent between the end portions according to an n-gon with substantially equal angles, where $n \geqq 6$, and the bent portions are interconnected by straight portions.

2. An electrical cooking unit as claimed in claim 1, wherein the lamp vessel is bent according to an octagon and is filled with an inert gas containing a halogen or halogen compound.

3. An electrical cooking apparatus comprising a hot plate transparent to IR radiation, under which an electrical cooking unit as claimed in claim 1 or 2 is arranged so that the electrical lamp faces the hot plate.

4. An electrical cooking unit as claimed in claim 2 wherein said lamp vessel comprises a glass having an $SiO_2$ content of at least 95% by weight.

5. An electrical cooking unit as claimed in claim 3, wherein said lamp vessel comprises a tungsten filament.

6. An electrical cooking unit as claimed in claim 5, wherein said filament is substantially a helically wound filament, having an operating temperature of about 1200° to about 1500° C., and arranged in the lamp vessel without supports.

7. An electrical cooking unit as claimed in claim 6 wherein said lamp vessel contains an inert gas and a halogen or halogen containing compound.

8. An electrical cooking unit comprising:

a housing having a base wall, sidewalls extending from the base wall, and at least one opening;

an electrical IR lamp having (a) a tubular lamp vessel sealed in a vacuum-tight manner, having first and second end portions extending beside each other and provided with a respective seal, which lamp vessel extend from its first to its second end portion, the lamp vessel being bent between the end portions according to a polygon having at least six substantially equal sides; (b) a respective metal foil embedded in the respective end portions seals; (c) a respective outer current conductor to said foil; (d) a respective inner current conductor connected to said foil; and (e) a tungsten filament connected to said respective inner current conductors, said lamp being arranged in said housing so that its end portions are passed through the at least one opening in its side walls to the exterior.

9. An electrical cooking unit as claimed in claim 8 wherein said polygon is selected from the group consisting of hexagons, octagons and decagons.

10. An electrical cooking unit as claimed in claim 9 wherein said polygon is an octagon; said filament has an operating temperature of about 1200° C. to about 1500° C. and is arranged in said vessel without using supports; the sidewalls of said housing are covered with a thermally isulating material; and the lamp is filled with an inert gas and a halogen or halogen compounds.

11. An electrical cooking unit as claimed in claim 10 wherein said lamp is filled up to a pressure of 1 bar with argon to which 0.2% by volume of $CH_2Br_2$ and 0.15% by volume of $CH_3I$ has been added.

* * * * *